US007018186B2

(12) United States Patent
Gillert et al.

(10) Patent No.: US 7,018,186 B2
(45) Date of Patent: Mar. 28, 2006

(54) FEED PUMP

(75) Inventors: Georg Gillert, Ostbevern (DE); Dirk Henningsen, Ostbevern (DE)

(73) Assignee: Kreyenborg Verwaltungen und Beteilgungen GmbH & Co. KG, Munster (DE)

( * ) Notice: Subject to any disclaimer, the term of this patent is extended or adjusted under 35 U.S.C. 154(b) by 87 days.

(21) Appl. No.: 10/485,632

(22) PCT Filed: Aug. 31, 2002

(86) PCT No.: PCT/DE02/03214

§ 371 (c)(1),
(2), (4) Date: Feb. 3, 2004

(87) PCT Pub. No.: WO03/054393

PCT Pub. Date: Jul. 3, 2003

(65) Prior Publication Data

US 2004/0184939 A1 Sep. 23, 2004

(30) Foreign Application Priority Data

Dec. 12, 2001 (DE) ..... 101 61 021
Jan. 24, 2002 (DE) ..... 102 02 620

(51) Int. Cl.
*F04C 15/00* (2006.01)

(52) U.S. Cl. ..... 418/102; 418/206.8; 415/112; 415/176

(58) Field of Classification Search ..... 418/102, 418/181, 206.8; 415/111, 112, 176, 175
See application file for complete search history.

(56) References Cited

U.S. PATENT DOCUMENTS 4,859,161 A * 8/1989 Teruyama et al. ..... 418/102
5,253,988 A 10/1993 Huniziker et al.
6,135,741 A * 10/2000 Oehman, Jr. ..... 418/102

FOREIGN PATENT DOCUMENTS

| | | |
|---|---|---|
| DE | 25 17 484 | 11/1976 |
| EP | 0 628 725 | 12/1994 |
| FR | 1 223 115 | 6/1960 |
| GB | 322 778 | 12/1929 |
| JP | 5-52186 | 3/1993 |
| JP | 05052185 A * | 3/1993 |

OTHER PUBLICATIONS

Patent Abstracts of Japan. JP 63-085276. Apr. 15, 1988.

* cited by examiner

*Primary Examiner*—Theresa Trieu
(74) *Attorney, Agent, or Firm*—Merchant & Gould P.C.

(57) ABSTRACT

The invention relates to a feed pump for delivering fluid media, wherein the pump bearings are lubricated by the feed medium itself. Connecting channels with valve devices are provided on the suction side and on the pressure side upstream and downstream, respectively, of a displacement element and link the bearing area of the pump with the production channel. Said connecting channels are configured as straight bores in the pump housing. The valve devices are configured as tappets that are disposed in the associated connecting channel sections so as to be displaced while being tight with respect to suction.

3 Claims, 1 Drawing Sheet

FEED PUMP

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

FIELD OF THE INVENTION

The invention relates to a feed pump for delivering fluid media wherein the pump bearings are lubricated by the feed media itself.

BACKGROUND OF THE INVENTION

In many chemical conveyor systems, gear pumps or rotary piston pumps are used to deliver the medium, the lubrication necessary for the plain bearings of the pump taking place through the feed medium itself.

According to GB 322 778, the medium to be delivered normally has a high fluidity. In the normal operation of the system, there prevails on the suction side of the pump a pressure P1 that is lower than the pressure D2 prevailing on the pressure side of the pump, and through this pressure difference the feed medium is pressed or sucked, as the case may be, over the surfaces of the plain bearings to be lubricated. This actual feed medium acting as the lubricant is released again into the material current on the suction side of the pump, since on the suction side and on the pressure side connecting channels with valve devices are arranged before and after the actual pump, which connecting channels connect the bearing area of the pump to the production channel.

If, for any production-technology reason, the normal pressure difference between the region before the pump and the region after the pump becomes reversed, i.e. the suction side normally showing a low pressure suddenly shows a higher pressure than the pressure side, which normally shows a higher pressure, it has become known in practice to design the provided valve device as a spring-controlled valve that automatically closes or opens the associated connecting channels depending on the prevailing pressure.

This reversal of the pressure difference between the region before and after the actual pump always occurs when the region after the pump, for example for production-technology reasons, is for example suddenly opened to the atmosphere, in order to carry out any operation after the pump, for example on the attached production equipment. The spring-controlled valves provided in a known manner operate satisfactorily with low-viscosity, fluid media.

Described in U.S. Pat. No. 5,253,988 is a gear pump in which a bypass connection with controllable valve is provided from the pressure side of the pump to a lubricant inlet for the bearing, in order to intensify the cleaning in the bearing region during the cleaning of the gear pump with bearings by means of a cleaning medium. Via this bypass conduit, during normal operation the bearing is fed from the low-pressure side of the pump with a lubricant stream from the conveyed main stream. With the aid of the recirculation, the cleaning action in the bearing of the cleaning medium conveyed through the pump is intensified.

In the processing of high-viscosity polymer melts, e.g. according to JP 05-052 186 A, such valves cannot be used. In the case of high-viscosity polymer melts, these known, spring-controlled and spring-loaded valves would clog and are thus not functional in these feed media.

Described in EP 0 628 725 A is a gear pump having a rotor shaft that is plain-bearing supported on at least one side in a housing-side, rotationally-fixed bearing body and is lubricated with the feed media, wherein the axially outside-lying plain-bearing termination interacts with the low-pressure side of the pump, in order to make possible a reflowing of the lubricant into the main feed medium stream, wherein in or on the bearing body at least one channel passing through in the axial direction links the plain-bearing termination with the low-pressure side of the pump. This channel be adjusted with respect to its flow cross section, as the inlet opening into the channel can be changed by means of an adjustment screw. It is thereby supposed to be possible, for example during the powering up of a pump, to take into consideration the changing rheological characteristics of the feed medium.

BRIEF SUMMARY OF THE INVENTION

The invention is based on the task of making possible a reversal of the feed media lubricating the plain bearings even with the use of high-viscosity polymer melts, in connection with which a purging of the connecting channel should be simultaneously possible during the delivery of the high-viscosity polymer melt.

It is proposed that, instead of a spring-loaded flap valve or multiple-way valve, valve plungers be used, wherein the connecting channels provided in the pump housing are formed as straight-line bores and the valve tappets completely close these connecting channels, i.e. suction-tight, but are arranged displaceably in these connecting channels. The valve tappets are adapted to these connecting channels not only with respect to the diameter of the bores, but also with respect to the length of the bores; in other words, the valve tappets close off the channels over their entire length.

Thus, in the closed state, on the one hand the flow of the feed medium is stopped, and on the other hand the bore is simultaneously purged of the polymer material present in it, so that a cracking of this material inside the bore cannot occur.

The controlling of the valve tappets can take place automatically via pressure sensors, the pressure in the production channel being measured before and after the pump and used to control the valve tappets.

While in the preceding the invention is explained by considering high-viscosity polymer melts as an example, the arrangement according to the invention can also be applied in the case of general fluid media and in that context replace the known flap valves.

BRIEF DESCRIPTION OF THE SEVERAL VIEWS OF THE DRAWINGS

In the following, an embodiment example of the invention is explained with reference to the drawings. In the drawings.

DETAILED DESCRIPTION OF THE INVENTION

Figure 1:
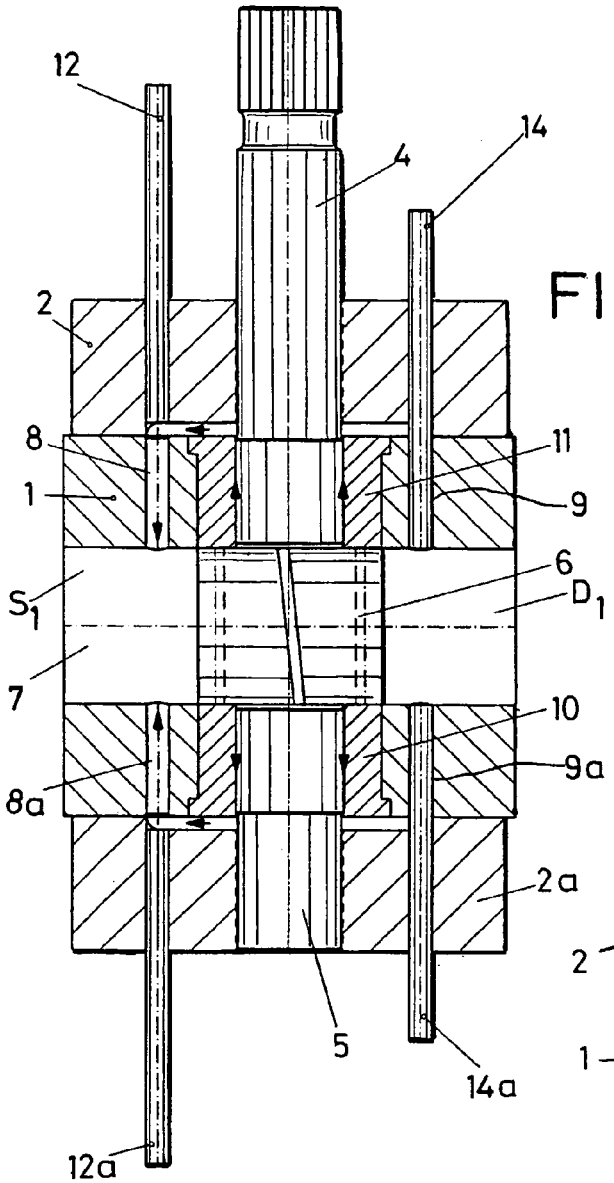
FIG. 1 shows an arrangement in which, in the normal manner, a pressure prevails at the suction side of the actual pump that is lower than the pressure prevailing at the pressure side of the pump after the pump.

In the drawings, indicated with 1 is a pump housing having a pump cover 2 and 2*a*. Inside the pump housing is arranged a displacement element 6, for example a gear, which is driven by a drive shaft 4 and supported by plain bearings 10 and 11.

The displacement element 6 is arranged in a production channel 7 and thus creates a suction side $S_1$ and a pressure side $D_1$ in the production channel 7. At 10 and 11 can be seen the plain bearings for the drive shaft 4, and the medium flowing or propelled in the production channel 7 is led back again to the production channel through the plain bearings, connecting channels 8 and 8*a* being provided on the suction side $S_1$. The flow of this production medium, which at the same time serves as the lubricant, is indicated by the arrow.

On the pressure side $D_1$ of the arrangement, connecting channels 9 and 9*a* are likewise provided.

These connecting channels 8, 8*a;* 9, 9*a* in the pump housing 1 are formed as straight-line bores and, in the illustrated embodiment example, penetrate the pump housing 1 in its entire height.

Aligned with the connecting channels 8, 8*a* and 9, 9*a,* tappets 12, 12*a* and 14, 14*a* are provided in the pump covers 2, 2*a*. For reasons of clarity, the actuation means of the tappets are not shown in the drawings.

In the arrangement according to FIG. 1, prevailing at the suction side $S_1$ is a pressure $P_1$ that is lower than the pressure $P_2$ that prevails at the pressure side $D_1$, so that by necessity the medium flowing in the production channel 7 is sucked through the plain bearings 10 and 11 as lubricant and is led back again to the production channel 7 via the connecting channels 8 and 8*a*.

Illustrated in FIG. 1 is the fact that the tappets 14 and 14*a* completely close off the associated connecting channels 9 and 9*a*.

Figure 2:
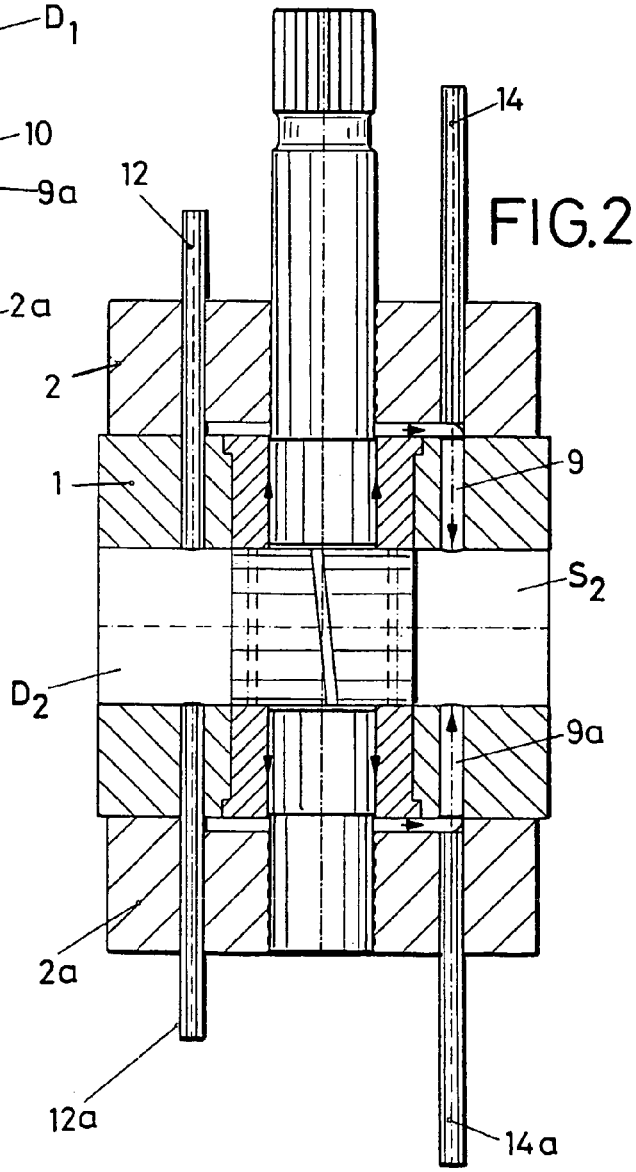
FIG. 2 shows an arrangement in which this pressure difference is reversed.

In the arrangement according to FIG. 2, a pressure reversal has occurred, i.e. prevailing at the suction side $S_2$ is a lower pressure $P_1$ than the pressure $P_2$ prevailing at the pressure side $D_2$, and for this reason the tappets 12 and 12*a,* controlled by sensors, have closed off the associated connecting channels 8 and 8*a* and the tappets 14 and 14*a* have been opened, so that the connecting channels 9 and 9*a* have thus been opened and from now on the feed medium flowing in the production channel 7 is pushed by the pump through the connecting channels 9 and 9*a* according to the drawn arrows.

Since the tappets 12, 12*a* and 14, 14*a,* when in their inserted state, in each case completely close off the associated connecting channels 8 and 8*a,* 9 and 9*a,* during their entry into the associated connecting channels these tappets simultaneously purge these connecting channels, i.e. they push the material possibly present in these connecting channels, namely the high-viscosity polymer melt, from the connecting channel into the production channel and thereby purge this connecting channel. Thus, in addition to the functional reversal of the lubricant flow, there occurs at the same time a complete closing off of the connecting channels, so that a residue of high-viscosity polymer melt in these channels is not possible.

The invention claimed is:

1. Feed pump for delivering fluid media, wherein pump bearings are lubricated by feed media, the feed pump comprising:

connecting channels with valve devices provided on a suction side as well as on a pressure side of a displacement element, wherein the connecting channels connect a bearing region of the pump with a production channel, and wherein the connecting channels are configured in a pump housing as straight-line bores and the valve devices are configured as tappets that are displaceable and are arranged in a suction-tight manner with respect to the associated connecting channels.

2. Feed pump as claimed in claim 1, wherein the length of the tappets corresponds to the length of the connecting channels.

3. Feed pump as claimed in claim 1, wherein the tappets are controllable subject to a pressure prevailing in the production channel before and after the displacement element.

* * * * *